United States Patent [19]

Niese et al.

[11] Patent Number: 4,520,853

[45] Date of Patent: Jun. 4, 1985

[54] DRUM POSITIONING SYSTEM

[75] Inventors: Leo J. Niese; Gary R. Sharlow, both of Toledo, Ohio

[73] Assignee: Reliance Electric Company, Cleveland, Ohio

[21] Appl. No.: 577,333

[22] Filed: Feb. 6, 1984

[51] Int. Cl.[3] ..... B65B 35/56

[52] U.S. Cl. ..... 141/168; 141/94; 141/171; 198/394

[58] Field of Search ..... 141/94, 1, 129, 168, 141/171, 392, 165; 198/394, 388, 383, 384

[56] References Cited

U.S. PATENT DOCUMENTS

| | | | |
|---|---|---|---|
| 1,298,489 | 3/1919 | Frelinghuysen et al. | 198/388 X |
| 3,610,398 | 10/1971 | Rice | 198/384 |
| 3,977,154 | 8/1976 | Kamisaka et al. | 141/171 X |
| 4,018,026 | 4/1977 | Kamisaka | 141/171 X |
| 4,091,597 | 5/1978 | Sanderson et al. | 141/171 X |
| 4,164,281 | 8/1979 | Schnier | 198/384 |

*Primary Examiner*—Ernest G. Cusick
*Attorney, Agent, or Firm*—Roy F. Hollander

[57] ABSTRACT

A method and apparatus for positioning a filler opening of a drum into alignment with a filler. A wheel on the end of a probe driven by a pneumatic motor is moved in a circular path on the surface of the drum and falls into and is captured by the filler opening. The probe continues to move, rotating the drum and the filler opening toward alignment with the filler. Alignment between the probe and filler is sensed and used to reverse the direction of movement of the probe, causing it to withdraw from the filler opening.

15 Claims, 6 Drawing Figures

DRUM POSITIONING SYSTEM

BACKGROUND OF THE INVENTION

This invention relates to container filling systems and more particularly to an apparatus and method for aligning the filler opening of a cylindrical container such as a drum with a filler.

Automatic filling systems are used widely for filling many types of containers with a variety of materials for storage or sale. The large cylindrical container known as a drum is typically employed for the storage and transportation of liquids but is also used to store powder and granular materials. In many cases the materials stored in the drum are dirty, noxious, or in others ways undesirable for human handling. This factor, in addition to efficiency and productivity, make it advantageous to use automated drum handling and filling systems.

In a typical drum filling system, each drum is transported along a conveyor line to a filler station where it is positioned for filling and filled. The drum is then moved on for closing and further handling. Each drum is filled through a bung or filler opening in the top surface and close to the outer edge of the drum. The filler opening is quite small relative to the diameter of the drum. For filling, each drum must be positioned so that the bung or filler opening is vertically aligned with a filler shaft. Since the drums arrive at the filler station with their filler openings in random angular positions with respect to the filler shaft, they must be positioned for filling.

Positioning methods presently in use employ one or more rubber rollers which engage the side of the drum and rotate it until a sensor determines that the filler opening is in the proper position, aligned with the filler. Placement of the sensor is quite important since the drum must be stopped at precisely the correct location. In many cases, however, the drum will have a slippery surface, such as from oil or other fluid accumulated over a long period, resulting in a certain amount of slippage of the rollers. Because of this slippage, the drum may at times not be stopped in the correct filling position.

SUMMARY OF THE INVENTION

The present invention provides an improved drum positioning system and method which substantially eliminates the disadvantages described above encountered with prior methods and systems.

According to the present invention, a probe is placed in contact with the surface of the drum having the filler opening and moved with respect to the surface in a path intersecting the filler opening. The probe is engaged by the filler opening and moves moves it toward alignment with the filler. When alignment is sensed between the filler and the filler opening the probe is withdrawn.

Preferably, the probe includes a small wheel urged into contact with the surface of the drum. The wheel moves easily along the drum surface and drops into the filler opening to positively locate the opening and provide reliable and positive driving engagement between the drum and the probe. Also, alignment of the probe with the filler may be sensed to determine alignment between the filler and the filler opening.

Thus, the drum is rotated into the filling position by the same means which is used to sense alignment between the filler and the filler opening. Also, the engagement between the probe and the filler opening prevents slippage. The system provides reliable positioning of the filler opening in a simple manner.

DESCRIPTION OF THE PREFERRED EMBODIMENTS

Figure 1:
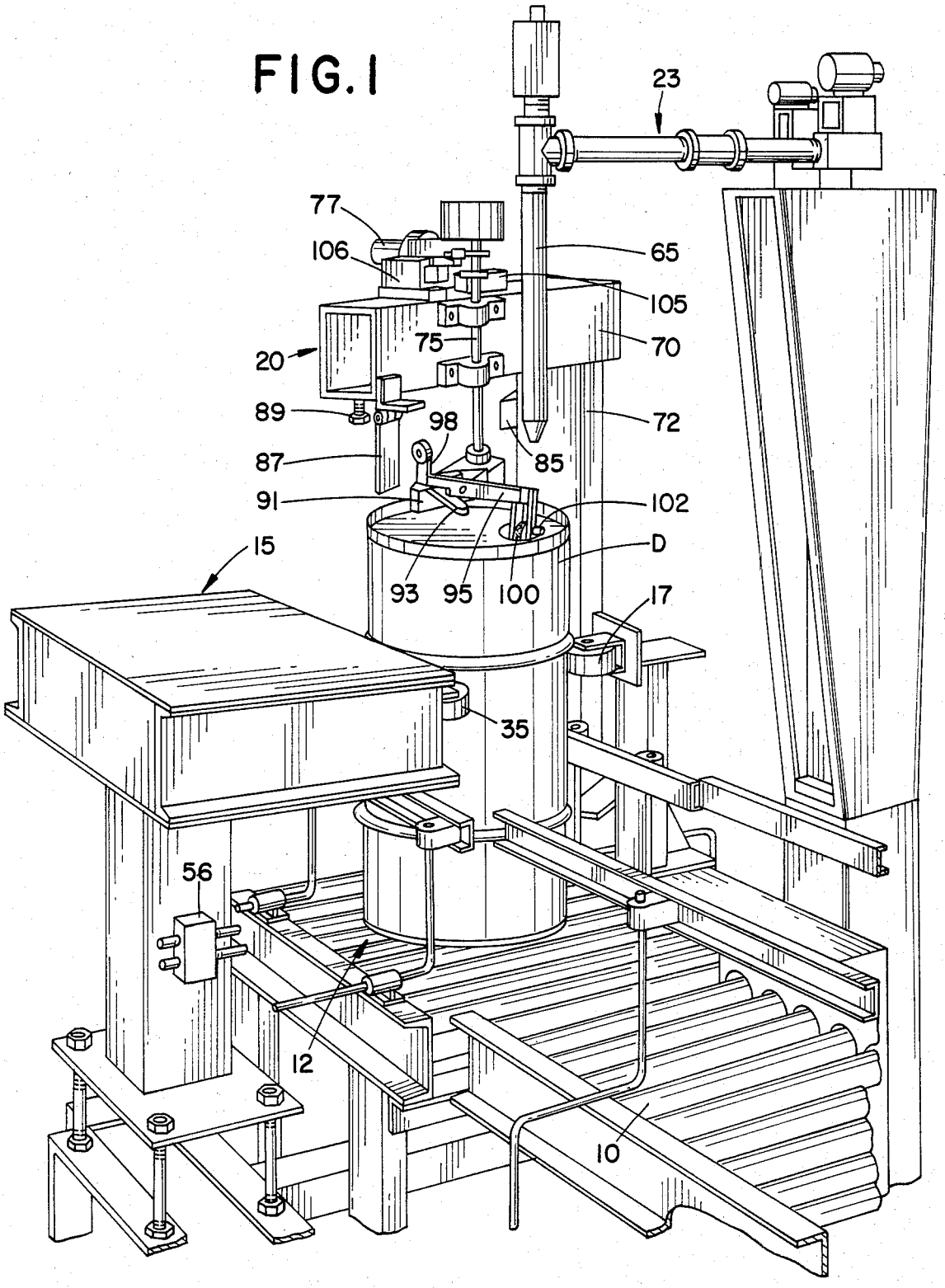
FIG. 1 is a perspective view of a drum filling system incorporating positioning apparatus according to the present invention.
Figure 2:
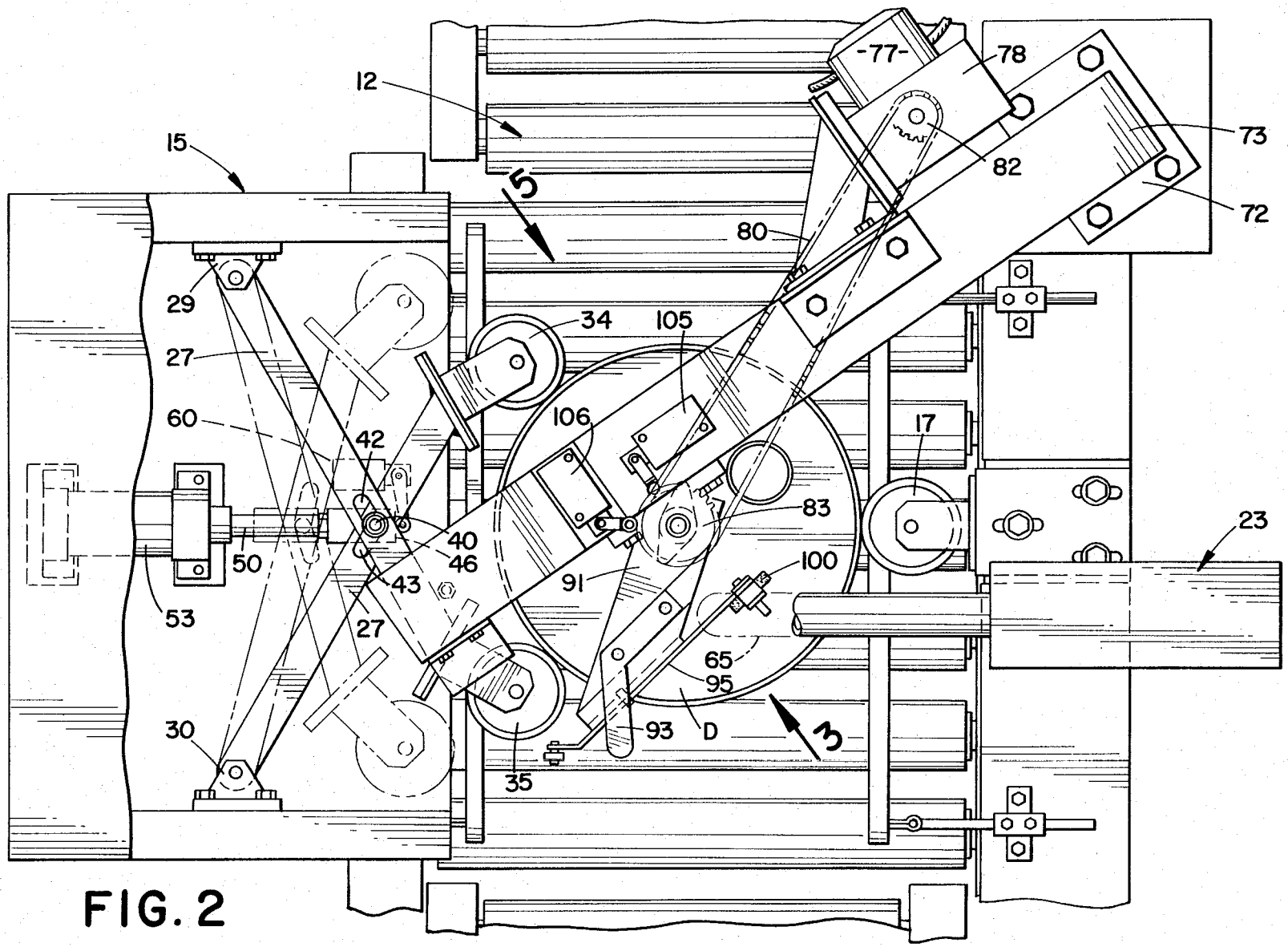
FIG. 2 is a plan view of the system of FIG. 1.

Referring now to the drawings and initially to FIGS. 1 and 2, a drum D to be filled is moved along a conveyor 10 to a filler station 12. At the filler station drum D is positioned and then filled with a desired volume of liquid. The filling and positioning means located at station 12 include a drum centering mechanism 15, a fixed wheel 17, a drum filler opening aligner generally designated 20 and a filler mechanism 23.

As shown in FIG. 2, drum centering mechanism 15 includes a pair of crossed arms 26, 27 each pivotally mounted at one end in a bracket 29, 30 and provided at its other end with a wheel 34, 35 with a cover of rubber or other resilient, high friction material. Arms 26 and 27 are connected together about midway of their length by means of a pin 40 extending through slots 42, 43 in the respective arms and to an extension member 46. A piston arm 50 of a pneumatic piston and cylinder arrangement 53 is connected to the end of extension member 46. Piston arm 50 is extended or retracted by means of fluid supplied to one or the other end of piston-cylinder arrangement 53 through a power valve 56 (FIG. 1). Extension of piston arm 50 causes drum D to be centered beneath aligner 20 and held there by movable wheels 34, 35 and fixed wheel 17. A limit valve 60 is operated by a cam on extension member 46 when the extension member has reached a position where the drum is centered beneath aligner 20.

Drum filler mechanism 23 is of conventional design and will not be described in detail. The filler mechanism includes a filler shaft 65 with which the filler opening of drum D is aligned.

Figure 3:
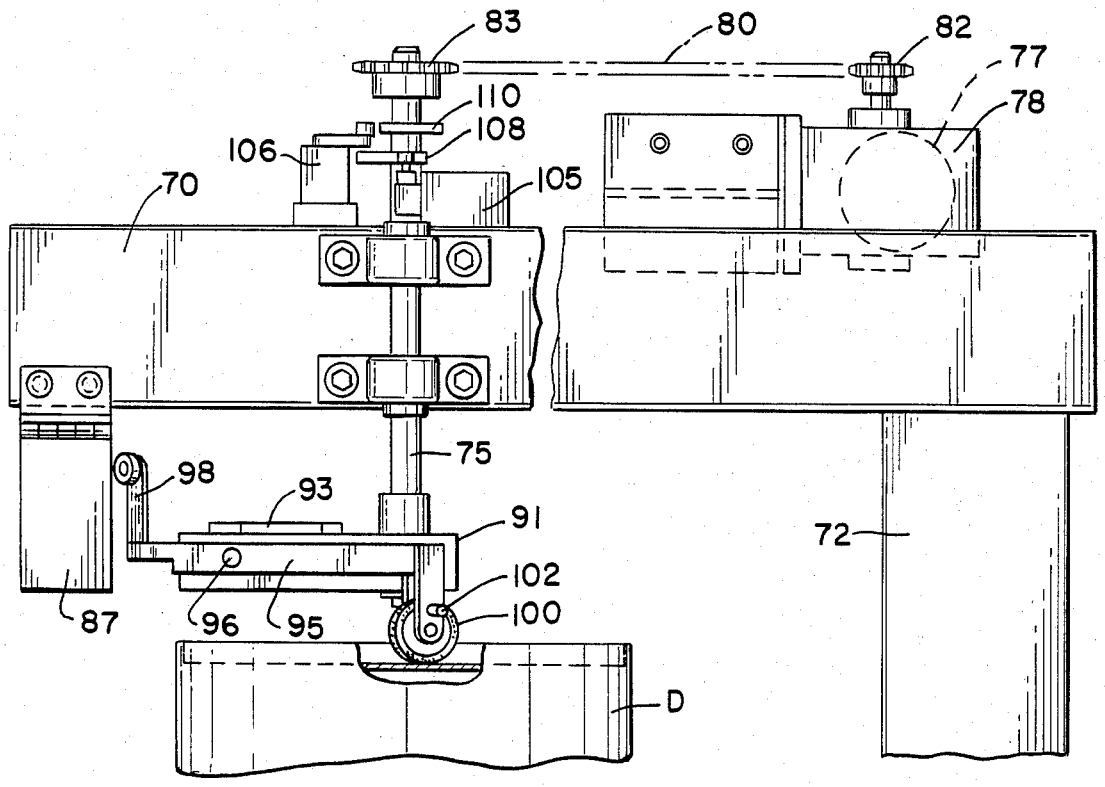
FIG. 3 is a partial side elevation in the direction of arrow 3 in FIG. 2 with the probe wheel in contact with the surface of the drum.
Figure 4:
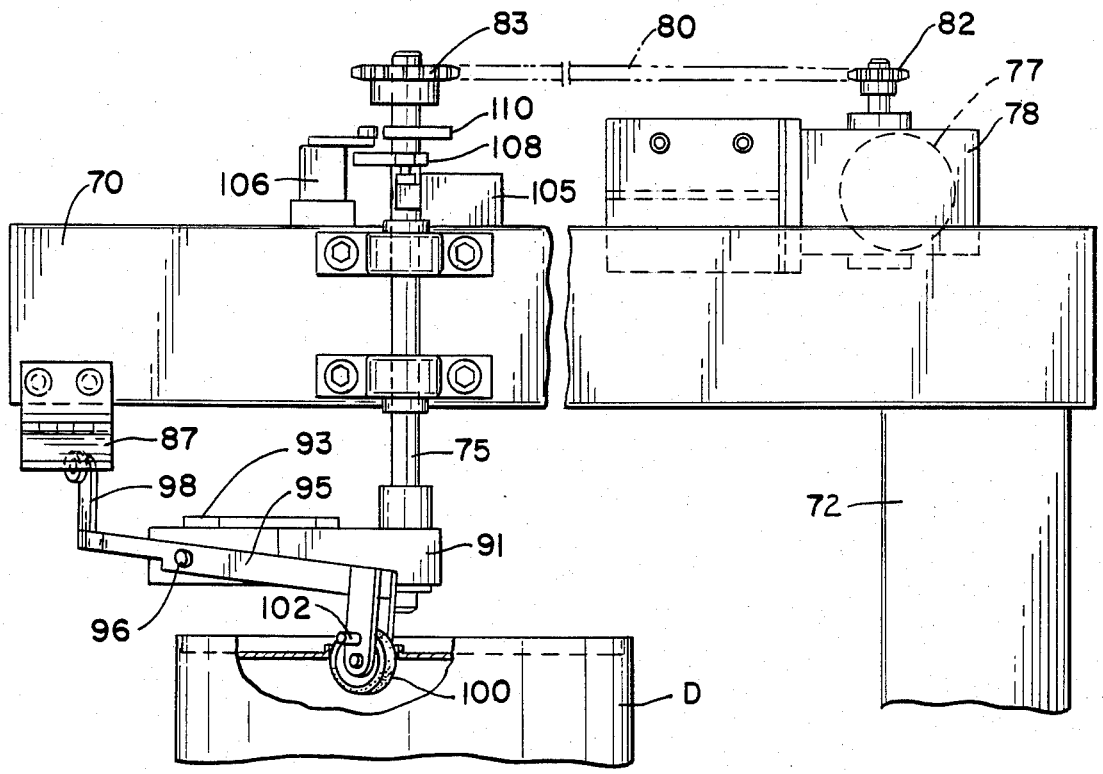
FIG. 4 is a partial side elevation similar to FIG. 3 but with the probe wheel engaging the filler opening of the drum.
Figure 5:
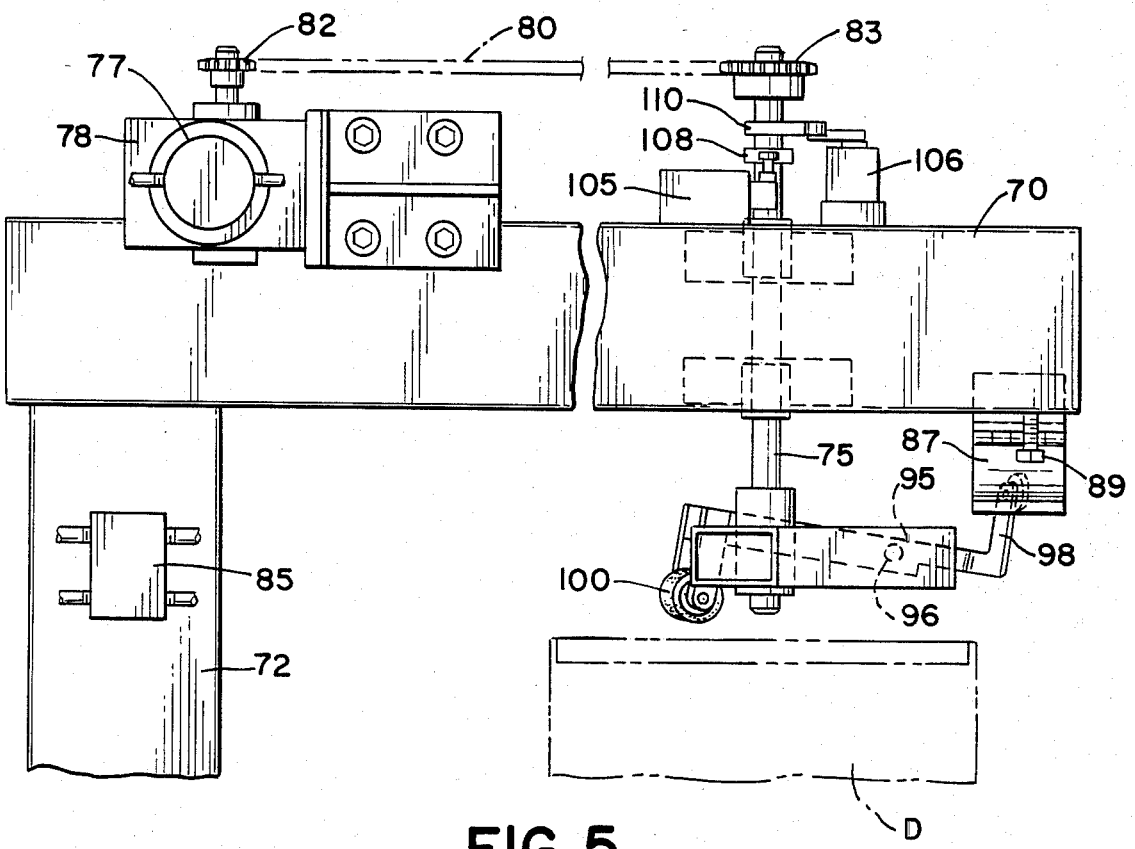
FIG. 5 is a partial side elevation in the direction of arrow 5 in FIG. 2 with the probe wheel retracted.

Referring now to FIGS. 3–5 along with FIGS. 1 and 2, filler opening aligner 20 includes a horizontal support arm 70 mounted on a support column 72. Support arm 70 extends over drum D and has mounted thereon a rotatable shaft 75 centered over the drum. A reversible pneumatic motor 77 rotates shaft 75 through a gear reducer 78, a drive chain 80 and sprockets 82 and 83. Drive fluid is supplied to motor 77 to cause it to rotate in one or the other direction through a power valve 85 (FIG. 5) mounted on column 72.

A hinge plate 87 is mounted on the end of support arm 70 in such a manner that it is free to pivot about its hinge to a substantially horizontal position in a direction toward the viewer in FIG. 3 and away from the viewer in FIG. 5. The angle through which hinge plate 87 may pivot in the opposite direction, that is, away from the viewer in FIG. 3 and toward the viewer in FIG. 5, is limited to an angle of less than 90° by a stop screw 89 in the bottom surface of support arm 70. The function of hinge plate 87 will become apparent below.

A pivot arm 91 is mounted on the lower end of shaft 75. An angle arm 93 is mounted on the upper surface of pivot arm 91 for a purpose described below. A roller arm assembly 95 is mounted pivotally on the outer vertical surface of pivot arm 91 by means of a pin 96. Roller assembly 95 includes an upwardly extending lever arm 98 at one end and a downwardly extending bracket supporting a probe wheel 100 at the other end. The location of pivot pin 96 is such that wheel 100 will be urged against the upper surface of drum D by its own weight and the length of the moment arm from pivot pin 96. A pin 102 projects horizontally from the mounting bracket of wheel 100 and serves a purpose described below.

A pair of limit valves 105 and 106 are mounted on support arm 70. Limit valve 105 is actuated by a cam 108 mounted on shaft 75 when the shaft has rotated to a position in which wheel 100 is aligned with filler shaft 65. Limit valve 106 is actuated by cam 110 mounted on shaft 75 when the shaft is rotating in the reverse direction and has reached the home or stop position.

To describe the operation of aligner 20, when drum D has been centered beneath the aligner, shaft 75 is at the home or stop position shown in FIG. 5. Hinge plate 87 has been pivoted toward the viewer in FIG. 5 into contact with stop screw 89 and is exerting downward force on lever arm 98 of roller assembly 95 to cause the roller assembly to pivot about pin 96 and lift wheel 100 off the surface of drum D.

To begin the alignment process, shaft 75 is rotated in the counterclockwise or forward direction to move roller assembly 95 away from hinge plate 87 so that wheel 100 contacts the surface of drum D. Wheel 100 rolls along the surface of drum D until it falls into the filler opening of the drum to a depth permitted by pin 102. Shaft 75 continues to rotate in the forward direction causing the drum to be rotated. As shaft 75 continues to rotate in the counterclockwise direction, roller assembly 95 will approach hinge plate 87 from the side adjacent stop screw 89. Arm 98 will pivot hinge plate 87 out of the way of roller assembly 95, away from the viewer in FIG. 5. This, together with the freedom of angular movement of hinge plate 87 in that direction permits the roller assembly to pass the hinge plate without being affected by it as shown in FIG. 4.

As shaft 75, roller assembly 95 and drum D continue to rotate lever arm 98 passes hinge plate 87 and allows it to return to its vertical position shown in Figure 1. When shaft 75 reaches a position where wheel 100 and the filler opening of drum D is aligned with filler shaft 65, limit valve 105 is operated and causes shaft 75 to rotate in the opposite, or clockwise, direction. This clockwise rotation of shaft 75 causes wheel 100 to be rolled backwards out of the filler opening and on to the surface of drum D. As roller assembly 95 is rotated in the clockwise direction, lever arm 98 contacts hinge plate 87 and pivots it away from the viewer in FIG. 3 until its pivotal motion is stopped by contact with stop screw 89. At this point further clockwise rotation causes downward force to be exerted on lever arm 98 to lift wheel 100 off the surface of drum D. When wheel 100 has been retracted shaft 75 will have rotated to a position where limit valve 106 is actuated to cause the motor to stop and leave roller assembly 95 in its home or stop position. With the filler opening of drum D now aligned with filler shaft 65 the drum can be filled to the desired extent and moved on to make way for the next drum to be positioned and filled.

Figure 6:
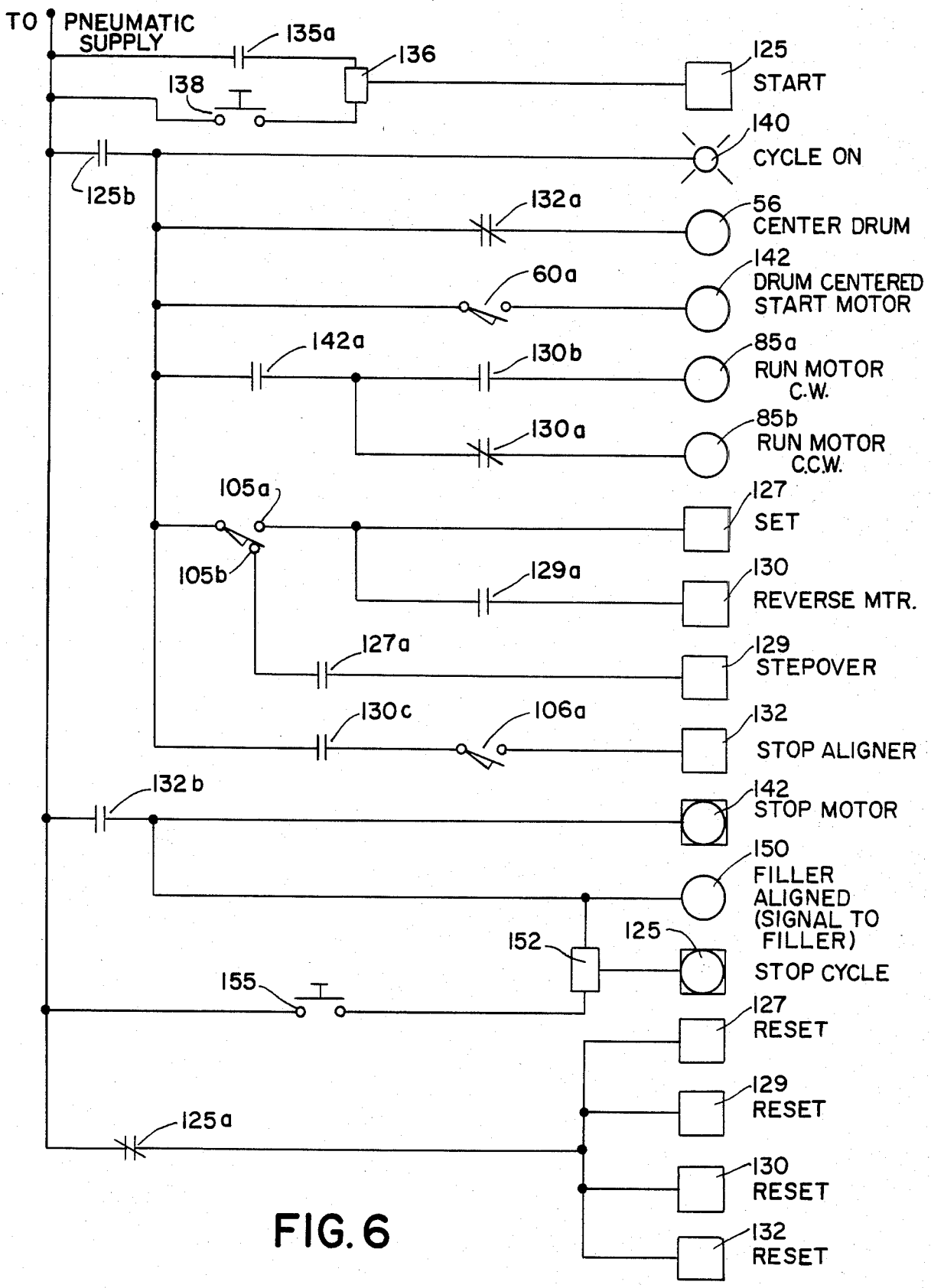
FIG. 6 is a schematic diagram of the pneumatic control system for the drum positioning apparatus.

FIG. 6 illustrates the pneumatic control logic for the positioning apparatus. Prior to starting the drum centering and filler aligning sequence, fluid is supplied through a normally open port **125*a* of a detent "start" valve 125 to insure that detent valves 127, 129, 130 and 132 are in the "reset" condition. When drum D is ready to be centered, a start signal is provided from, for example, a remote controller (not shown) by opening a normally closed port 135*a* to "set" start valve 125. Alternatively, a manual start signal can be provided through shuttle valve 136 by means of manual start valve 138**.

When start valve 125 is set, normally open port **125*a* closes and normally closed port 125*b* opens. Fluid is supplied through port 125*b* to activate an indicator lamp 140 through an appropriate fluid actuated electrical switch (not shown). Fluid is also passed through normally open port 132*a* of detent valve 132 to actuate power valve 56 and cause arms 26 and 27 of centering mechanism 15 to center drum D. When the drum is centered, limit valve 60 (FIG. 2) is actuated and fluid is passed through port 60*a* to actuate a spring loaded valve 142. Fluid is then passed through port 142*a* and through a normally open port 130*a* of valve 130 to port 85*b* of power valve 85. This causes power valve 85 to be switched to a position in which motor 77 rotates shaft 75** in the counterclockwise or forward direction.

As described briefly above, wheel 100 will then move into contact with the surface of drum D and roll along its surface until it is captured by the filler opening of the drum. Either before or after wheel 100 is so captured it will pass through the position where it is aligned with filler shaft 65 causing limit valve 105 to be actuated momentarily. This allows fluid to be passed through port **105*a* to set detent valve 127 which opens port 127*a*. When wheel 100 has moved past the aligned position, valve 105 returns to its normal position and fluid is passed through ports 105*b* and 127*a* to set detent valve 129 and open port 129*a***.

Shaft 75 rotates the captured wheel 100 and drum D in the manner described above until wheel 100 (and the filler opening) is again aligned with filler shaft 65. At this point, limit valve 105 is again actuated and fluid is passed through port **105*a* and port 129*a* to set detent valve 130. Thereupon, port 130*a* is closed, port 130*b* is opened and fluid is conducted to port 85*a* of power valve 85 to cause it to provide fluid to rotate shaft 75** in the clockwise, or reverse, direction.

Wheel 100 of roller assembly 95 thereupon rolls backward out of engagement with the filler opening and rotates in the clockwise direction on the surface of drum D until contact between lever arm 98 and hinge plate 87 causes wheel 100 to be lifted off the surface of the drum. Shaft 75 continues to rotate in the clockwise direction until limit valve 106 is actuated and fluid is conducted through port **106*a* and port 130*c* to set detent valve 132. Fluid is thereupon conducted through port 132*b* to release valve 142, closing port 142*a* and stopping motor 77. Fluid is also conducted through port 132*b* to actuate a valve 150 which provides a signal to filler mechanism 23 indicating that the filling procedure can be begun. Fluid is also conducted through port 132*b* and shuttle valve 152 to reset start valve 125 closing port 125***b*, opening port 125*a* and returning the control logic to its initial condition.

A manually operated emergency stop valve 155 is also included to provide a signal through shuttle valve 152 to reset valve 125 and interrupt the sequence, if necessary.

What is claimed is:

1. A method for positioning a filler opening of a drum into alignment with a filler comprising the steps of placing a probe in contact with a surface of the drum having a filler opening, moving the probe with respect to the drum surface in a path intersecting the filler opening until the probe engages the filler opening, moving the engaged probe toward the position of the filler, determining alignment of the filler with the filler opening, and withdrawing the probe from the filler opening.

2. A method as claimed in claim 1 including the step of exerting force on the probe in contact with the drum surface to cause the probe to be captured by the filler opening.

3. A method as claimed in claim 1 including the step of moving the probe in a circular path to intersect the filler opening.

4. A method as claimed in claim 1 including the step of moving the engaged probe in a circular path to rotate the drum and move the filler opening toward alignment with the filler.

5. A method as claimed in claim 1 including the step of sensing alignment of the engaged probe with the filler to determine alignment of the filler opening with the filler.

6. A method as claimed in claim 1 including the step of providing a rotatable wheel on an end of the probe for contact with the surface of the drum.

7. A method as claimed in clain 1 including the step of reversing the direction of movement of the probe to withdraw it from the filler opening.

8. Apparatus for positioning a filler opening of a drum into alignment with a filler comprising a probe, means for placing the probe into contact with a surface of the drum having a filler opening, means for moving the probe with respect to the surface of the drum in a path intersecting the filler opening to cause the probe to engage the filler opening and move said filler opening toward alignment with the filler, means for sensing alignment between the filler and the filler opening, and means responsive to said alignment for withdrawing the probe from the filler opening.

9. Apparatus as claimed in claim 8 including means for urging said probe into positive contact with the surface of said drum, whereby said probe positively engages said filler opening.

10. Apparatus as claimed in claim 8 including a rotatable wheel on an end of said probe for rolling contact with the surface of said drum.

11. Apparatus as claimed in claim 8 wherein said probe moving means includes means for moving the probe in a circular path intersecting said filler opening.

12. Apparatus as claimed in claim 8 wherein said probe withdrawing means includes means for reversing the direction of movement of said probe.

13. Apparatus as claimed in claim 8 wherein said alignment sensing means includes means for sensing alignment between said filler and said probe.

14. Apparatus for positioning a filler opening of a drum into alignment with a filler comprising a support, a rotatable shaft mounted on said support, a probe for engaging a filler opening, an arm connecting said probe to said shaft, means urging said probe in a direction parallel to said shaft for contact with a drum surface having a filler opening, means for rotating said shaft to move said probe into engagement with a filler opening, means responsive to a first angular position of said shaft representing alignment of a filler and a filler opening for reversing the direction of rotation of said shaft.

15. Apparatus as claimed in claim 14 wherein said probe includes a wheel for rolling contact with a drum surface.

* * * * *